United States Patent [19]

Raque et al.

[11] 4,102,113

[45] Jul. 25, 1978

[54] COVER FEEDING APPARATUS

[75] Inventors: Glenn F. Raque; Edward A. Robinson, both of Louisville, Ky.

[73] Assignee: Raque Food Systems Inc., Louisville, Ky.

[21] Appl. No.: 810,027

[22] Filed: Jun. 27, 1977

[51] Int. Cl.[2] ..... B65B 7/28

[52] U.S. Cl. ..... 53/366; 53/333; 53/334

[58] Field of Search ..... 113/113 R; 53/333, 329, 53/334, 366

[56] References Cited

U.S. PATENT DOCUMENTS

| | | | |
|---|---|---|---|
| 2,975,574 | 3/1961 | Jorgenson et al. | 53/287 |
| 2,982,073 | 5/1961 | Zimmerer | 53/366 |
| 3,435,588 | 4/1969 | Johnson, Jr. et al. | 53/366 |
| 3,812,641 | 8/1974 | Bemiss | 53/329 X |
| 3,835,799 | 9/1974 | Huth et al. | 53/366 |
| 3,866,387 | 2/1975 | Davis | 53/333 |

*Primary Examiner*—Leon Gilden

*Attorney, Agent, or Firm*—Edward M. Steutermann

[57] ABSTRACT

Method and apparatus for selectively supplying and placing a generally planar cover of selected peripheral configuration over a cooperative opening for container while the container is in motion where the opening is surrounded by an outwardly directed generally horizontal cover receiving first flange means where the first flange has an upwardly extending peripheral second flange adapted to fully receive the cover within the second flange so the opening to the container is surrounded by the first flange which is adapted to receive and support the cover around the peripheral edges of the cover within the second flange including: conveyor means to move the container along a selected axis at a relatively constant first velocity with the opening upwardly directed; cover supply means to supply a cover to engage the first flange and in a direction generally parallel to the direction of travel of the container from a location above the moving container so the cover is received on the first flange means within the second flange means; cover feed means to receive the cover from the cover supply means and feed the cover onto the first flange means of the container means at a selected second velocity where the velocity component of the cover in a direction parallel to the direction of travel of the container is in excess of the first velocity so the cover means engages the first flange and moves over the first flange in a direction parallel to the direction of travel of the container until the leading edge of the cover engages the front peripheral second flange and the cover is fully received within the second flange. Means can also be provided to bend a portion of the leading edge of the second flange over the cover.

9 Claims, 14 Drawing Figures

COVER FEEDING APPARATUS

BACKGROUND OF THE INVENTION

Various apparatus and arrangements are known which provide method and apparatus for feeding and applying a generally flat cover to a cooperative opening in a moving container where an outwardly extending substantially horizontal flange surrounds the opening to the container and where an upwardly directed peripheral flange surrounds a portion of the horizontal flange. The present invention provides a cover feed means in timed relation with the container conveyor means so the cover is automatically placed on the advancing conveyor so each cover engages the container first flange and is then urged into place over the container opening where the cover is secured.

Such apparatus and arrangements are useful in diverse applications but are particularly useful in supplying covers and applying such covers to the opening of aluminum foil tray-type food containers, for example, deep-drawn aluminum trays, as the trays are moved along a high speed process line after they have been filled.

In such applications, it is essential that the covers be accurately located and secured in place to avoid disruption of the process line and to, equally as important, prevent improper packaging.

Various prior art devices have been utilized for placing flat covers over container openings as, for example, shown in U.S. Pat. Nos. 3,263,393 and 2,595,849.

In the food processing and filling industry, trays are passed along a conveyor line and filled with selected food, covers are placed on the moving containers and sealed. In such applications, including other packaging arrangements to which the present invention applies, the material to be packaged is usually placed in a deep-drawn tray, for example, an aluminum tray, where a generally horizontal peripheral flange surrounds the opening of the material receiving portion of the tray and an upstanding lip is provided around an outer portion of the flange and adapted to be folded over to retain the cover which is placed on the horizontal flange.

One device previously used for placing a flat cover on the tray opening has included a vacuum pick-up which lifts the cover from a stack and transfers the cover to a moving container as it passes the cover station. In such arrangements, the cover is placed on the container from a direction transverse to the direction of movement of the container so complex and expensive timing arrangements are required to properly place the cover.

In another, more common arrangement, as shown in U.S. Pat. No. 2,595,849, covers are removed from a stack and fed from above the conveyor line in the direction of travel of the conveyor where the cover is retained and supported on a mechanism while being placed over the opening to the container by spring tension means acting upon the fingers to grip the cover where the release of the fingers is effective by positive action of the mechanism and where means are provided to control movement of the cover. In such arrangements, it has been required to very accurately index the cover feed so the leading edge of the cover precisely engages the front edge of the container just inside the leading edge of the upstanding flange or else the cover is misplaced in the container and may overextend the front end of the container leading to improper packaging.

SUMMARY OF THE INVENTION

The present invention provides a method and apparatus for placing a cover over the opening provided by a container, where the container is moved along conveyor means, and where the container has a horizontally extending first flange surrounding the opening with an upwardly extending flange surrounding a portion of the first flange where the cover is received inside the periphery of the second flange and received on the first flange.

The method and apparatus provided by the present invention is particularly useful in feeding a cover to a tray used to receive and hold food substances.

More particularly, the present invention provides a method and arrangement to accurately and effectively place a cover in the opening provided in a container while the container is in motion where the cover is fed to the moving container to engage the horizontal peripheral flange at a location behind the leading edge of the container and at a velocity, in the direction of travel of the container, greater than the line speed of the container so the cover moves forward over the peripheral flange to engage the frontmost upstanding flange including: conveyor means to move the container along a selected axis at a relatively constant first velocity, cover supply means to supply covers adapted to be received within the upstanding flange, in a path generally parallel to the direction of the travel of the container from a location above the container where cover feed means are provided to receive covers from the supply means and feed the covers onto the first flange means of the container at selected second velocity of the cover is in a direction parallel to the axis of travel of the container is in excess of the first velocity so the cover means engage the first flange and move over the first flange in a direction parallel to the direction of travel of the container until the cover is in place within the upwardly extending flange.

Further objects, uses, advantages of the present invention will become apparent to those skilled in the art from the drawings and descriptions hereinafter.

BRIEF DESCRIPTION OF THE DRAWINGS

Referring now to the drawings which illustrate one example of a method and apparatus within the scope of the present invention:

FIG. 1 shows tray 1, for example an aluminum foil tray of the type which can be processed in equipment in accordance with the present invention as shown in the accompanying drawings. As shown in FIG. 1, tray 1 advantageously includes an upstanding outer flange 3 around the periphery of a horizontal flange 2 which defines an opening 4 to the tray.

FIG. 2 is a perspective illustration of an arrangement within the scope of the present invention for feeding covers 16 to trays 1 which are received in a conveyor device including cooperative frames 66–67 where the bottom of the tray is received on a bar 65 with frames 66–67 and bar 65 carried by a chain 64 so the tray is moved along and between side guides 61 and 63. As shown, frames 66–67 and bar 65 are connected to an endless drive chain 64 driven, by drive means not shown, at a relatively constant speed in the direction shown. It will be understood that the apparatus shown is provided for the purpose of feeding and locating a cover for trays 1 where trays 1, carried by frames 66–67 are filled with selected materials, for example foods, at a location upstream from housing 11A-11B in equipment not shown and travel along the conveyor arrangement previously described to receive cover 16.

The speed of conveyor chain 64 and the rate of feed of covers 16 are necessarily interrelated as more particularly described hereinafter.

Housing 11A–11B provides a cover feeding and locating arrangement within the scope of the present invention for tray covers 16 stored in a rack defined by rods 13. Covers 16 are withdrawn singly to be fed to trays 1 as they are moved along the conveyor arrangement previously described.

Figure 3:
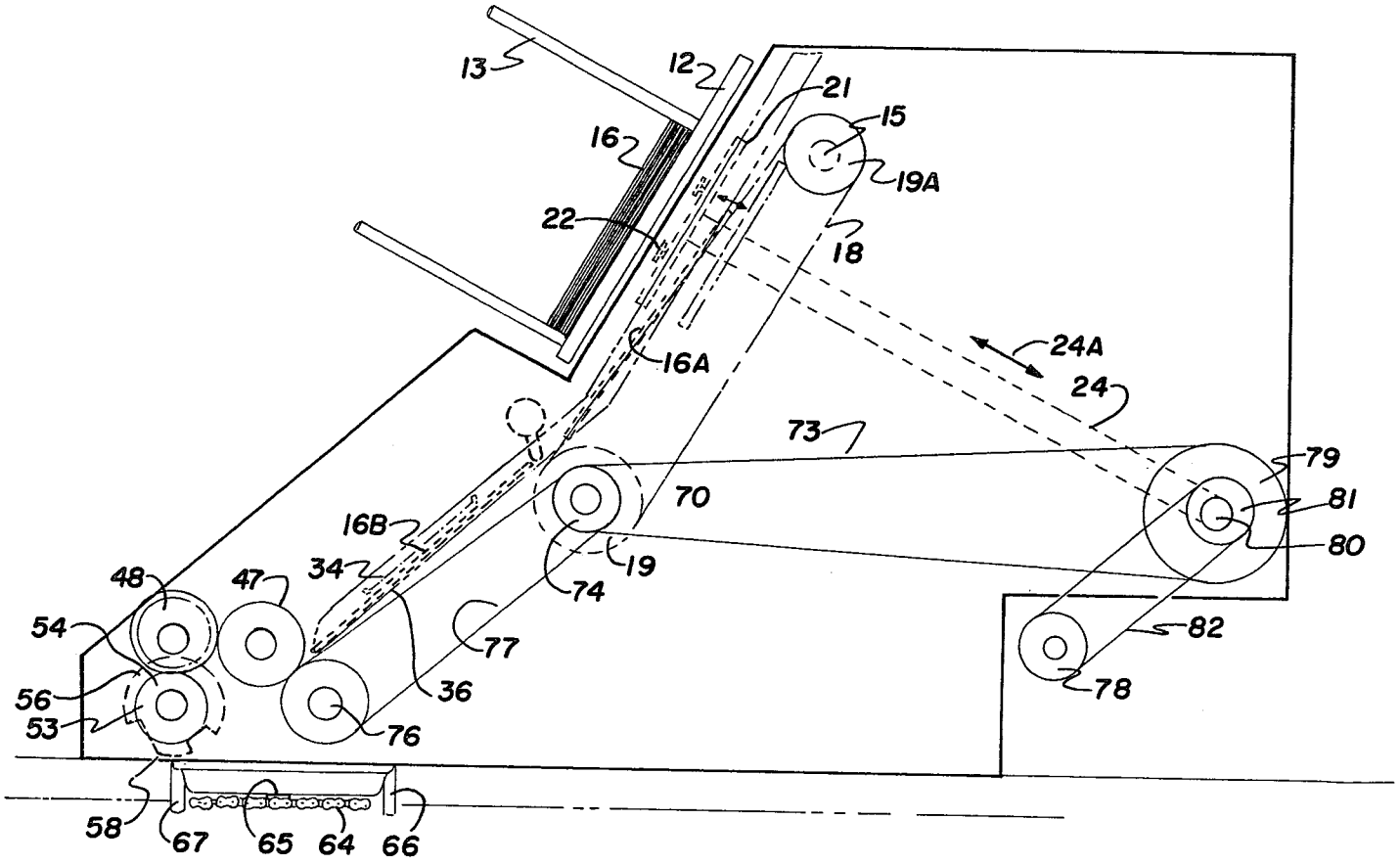
FIG. 3 is a schematic elevational view of the arrangement shown in FIG. 2.

In the arrangement shown in FIG. 3, covers 16 are drawn through an opening 14 (FIG. 2) by means of a vacuum platen 21 equipped with vacuum heads 22, where the vacuum heads 22 are supplied with vacuum by means now shown. Opening 14 is, advantageously, sized to be slightly smaller than the periphery of covers 16 so the covers 16, by slight bending, are drawn through opening 14.

Platen 21 is connected to a shaft 24 which is in turn connected to a rotating shaft 80 which can include an eccentric mechanism (not shown) and is driven by a sprocket 81 connected to a drive 78 by means of a chain 82.

Shaft 80 also carries a sprocket 79, to receive drive chain 73 which supplies power to the cover placing and closing arrangement hereinafter described. Drive 78 is driven by the mechanism (not shown) which drives conveyor chain 64 so by proper selection of sprocket diameters, the sequential timing of the tray feed and cover placement is provided.

Because of the eccentric connection of shaft 24 to shaft 80, rotation of shaft 80 results in oscillatory movement of shaft 13, as indicated by the arrows, 24A, so that as platen 21 is moved to operative engagement with the lowermost cover 16, the vacuum heads 22 contact the lowermost cover 16 and pull the cover through opening 14 upon further rotation of shaft 80. A sprocket 74 is connected to drive sprocket 79 by means of a drive chain 73 to rotate a shaft 70 which carries spaced pulleys 19. A second cooperative set of pulleys 19A are disposed for rotation on a shaft 20 located in the upper portion of housing 11A–11B, and endless belts 18 are provided around each set of pulleys 19, 19A for rotation therewith where pulleys 19 drive the belts 18. In operation, the covers 16 are drawn through opening 14, and applied to nip rollers 38, 41 as illustrated by covers 16A, 16B of FIG. 3. In operation, the cover contacts belts 18 as shown by cover 16A and moves with belts 18 until it contacts runners 36. Movement of belt 18 urges cover 16A along runners 36, and under guides 34 toward rollers 38, 31.

The cover, for example cover 16B, moves along belts 18 and runners 36, and upon disengagement from belts 18, is moved further by fingers 33 carried by a rotatable shaft 32. Fingers 33 move cover 16B along runners 36 until the leading edge of cover 16B is engaged by the nip between rollers 38 and 41, as shown in FIG. 3.

It will be understood, as previously discussed, that the speed of rotation of shaft 70 is selected to coordinate with the speed of belts 18 and shaft 80 so that fingers 33 are rotated to operative position to positively engage the rear edge of cover 16B. More particularly, the proper timing and sequency is provided by selection of the sprocket diameters of sprockets 79 and 74 to drive shaft 70 at a selected speed where shaft 70 also carries a gear 71 adapted to drive a cooperative meshing gear 31 carried by shaft 32 to rotate shaft 32, and fingers 31, at selected speed. It will be understood that the relative diameters of gears 31 and 71 provide the means to adjust the final speed of rotation of shaft 32. A sprocket 72 is also carried by shaft 70 and is provided with a drive chain 77 to drive a sprocket 76 carried by a rotatable shaft 41 to supply power for the nip rollers 38, 41 and the closure means described hereinafter.

Figures 4A, 4B, 4C, 4D, 4E, 5, 6, 7A, 7B, 7C, 7D:
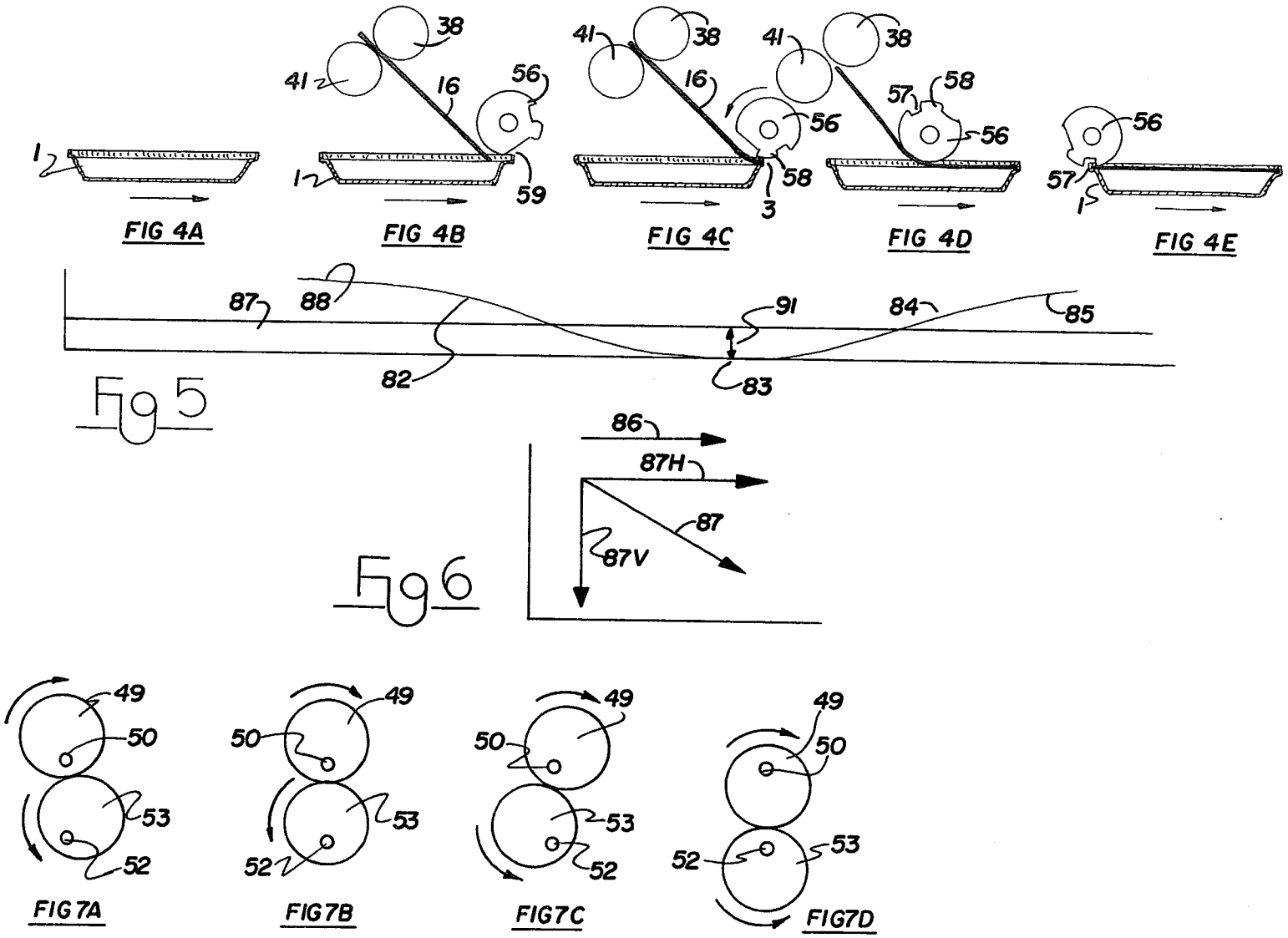
FIGS. 4A – 4E schematically illustrate one feature of method and apparatus in accordance with the present invention.
FIG. 5 is a graphic illustration of the relative velocities of a clamping device and tray in apparatus as shown in FIGS. 2 and 3.
FIG. 6 is a graphic illustration of the relative velocity of the cover feed and tray in a device as shown in FIGS. 2 and 3.
FIGS. 7A–7D are schematic illustrations of selected positions of the clamp device drive means shown in FIGS. 2 and 3.

Sprocket 76 is selected so shaft 39 is rotated at a predetermined speed, relative to the linear speed of conveyor chain 64 so that the shaft rotates nip rollers 38 and 41 to feed cover 16B at a selected speed as represented in FIG. 6 by vector 87, where the horizontal component 87h of the speed of cover 16B is greater than the speed of conveyor chain 64 as represented by vector 86. Shaft 39 likewise carries a gear member 46 which meshes with a gear 44, carried by shaft 37 to drive nip roller 38 at the same speed as shaft 39. Shaft 37 likewise carries a gear member 47 which meshes with a gear 48, rotatably carried by a rotatable stub shaft 50 connected to housing 11A. Gear 48 rotates shaft 50, which likewise carries an eccentrically mounted gear 49 where, more particularly gear 49 has an eccentric element 51, which advantageously provides eccentric rotation of gear 49. A gear 53 is carried by rotatable shaft 52 and is advantageously disposed to continuously mesh with gear 49 and likewise includes an eccentric mounting element 54 which receives driven shaft 52. Gears 49 and 53 are, advantageously, adapted so that the gears are in uniform constant mesh even though the rotation of the gear members is eccentric, as described hereinafter. In accordance with one feature of the present invention, a crimping device 56 is carried for rotation by shaft 52 to, as described hereinafter, to bend a portion of the leading edge of flange 3 over a cover placed in tray 1. Crimping device 56 can be a disc of generally circular configuration and advantageously includes a chord-like flat portion 59, a tooth portion 57, as described hereinafter, and a gap 57 as also described hereinafter.

Figures 1, 2:
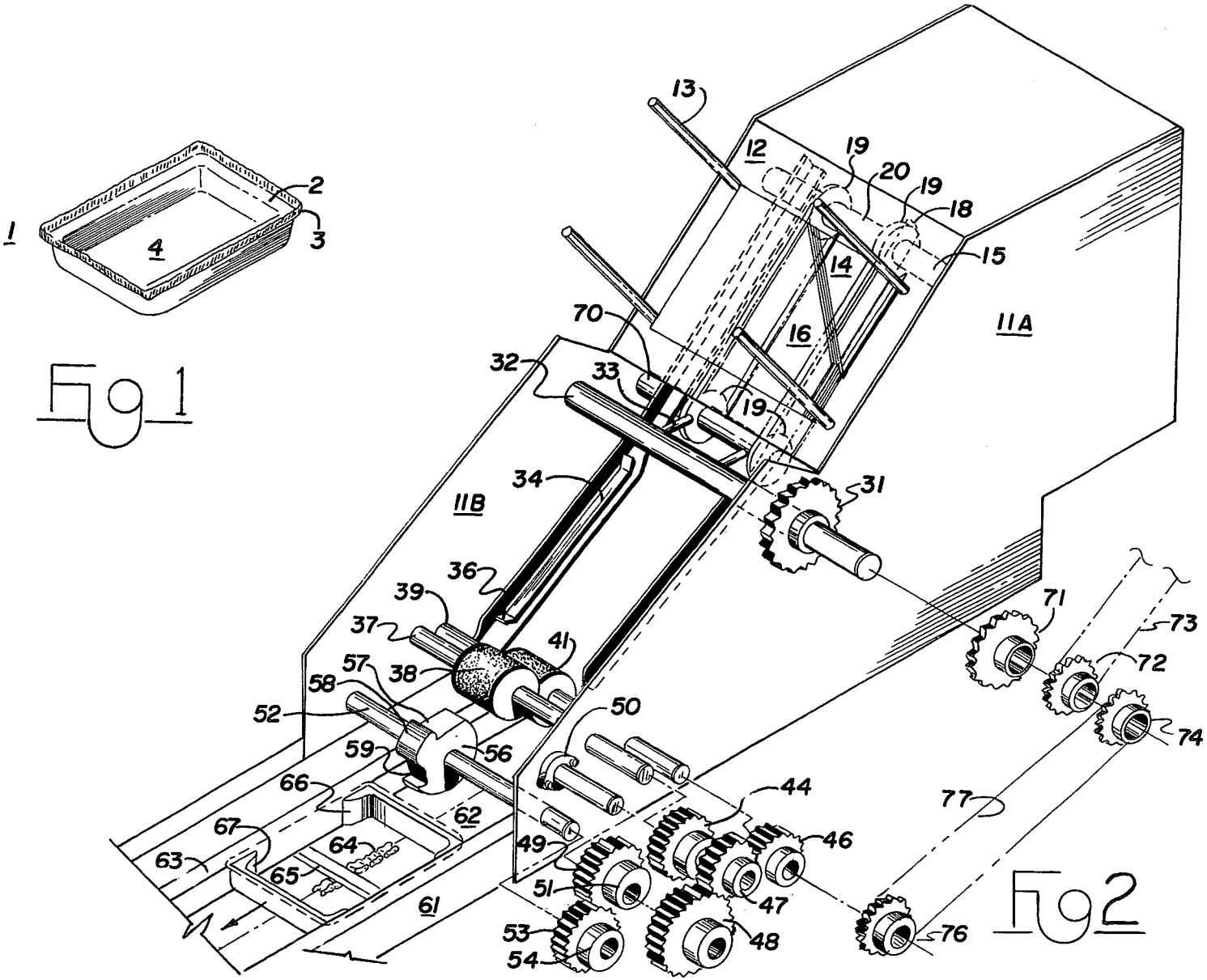
FIG. 1 is a perspective view of a tray of the type to be processed by apparatus in accordance with the present invention.
FIG. 2 is a, partially exploded, perspective view of one arrangement in accordance with the present invention.

Operation of crimping device 56 shown in FIGS. 2–3 is further exemplified in FIGS. 4A–E. Referring to FIG. 4A, a tray 81 is represented as moving along a conveyor line to receive a lid 16. In FIG. 4B, a lid 16 has been fed between nip rollers 41 and 38 to engage horizontal flange 2 of tray 1. FIG. 4C illustrates one feature of the present invention wherein nip rollers 41 and 38, which feed cover 15 at a horizontal speed greater than the line speed of tray 1 have caused the leading edge of cover 16 to move along the horizontal flange 2 to engagement with the front vertical flange 3 of tray 1. Because of the increased velocity of cover 16, the cover has taken a slight bend, as illustrated. As previously described, the relative velocities of the tray 1 and lid are indicated in FIG. 6 wherein the velocity of tray 1 is represented by the vector 86 while the actual velocity of cover 16 is represented by vector 87 and the horizontal velocity of the cover, in the same directon of travel as tray 1, is represented by vector 87h while the vertical velocity component of cover 16 is represented by vector 87v. As can be seen, the difference between the velocity of tray and the horizontal velocity of the cover is the difference in the length between the vectors 86 and 87h. In accordance with the feature of the present invention, so long as the horizontal velocity of cover 16 is greater than the velocity 86, cover 16 will engage horizontal flange 2 of tray 1 and move over the flange in the direction of travel of tray 1 in excess of the velocity of the tray so that cover 16 is firmly located against the front vertical flange 3.

In accordance with an additional feature of the present invention, a crimp is placed in the front edge of vertical flange 3 to retain cover 16 in position during subsequent processing and prior to final closure.

In the example of the present invention, shown in the figures, the crimp is accomplished by crimping member 56 which is located downstream from nip rollers 41, 38.

As previously described, crimping member 56 is rotated so the lower edge of the crimping device moves in the same direction as tray 1 but at variable speeds as a result of the eccentric mesh of gears 53, 49 as described hereinafter.

As shown in FIGS. 7A–D, gears 49 and 53 are oriented such that rotation of gear 53 causes shaft 52 to rotate crimping device 56 at the speed of rotation of shaft 52 where the speed varies sinusoidally as illustrated in FIG. 5 where line 88 represents the speed of the peripheral edge of device 56 for one full cycle of gears 49, 53. As previously described, gear 49 is a driven gear and rotates about shaft 50 to drive gear 53.

FIG. 5, as previously described, illustrates the sinusoidal velocity of the peripheral edge of device 56 and, in FIG. 5, line 87 represents the linear velocity of tray 1.

In FIG. 7A, gears 53 and 49 are in a position of rotation to provide a linear speed of the edge of crimping device 56 indicated at point 82 in FIG. 5 when the speed of device 56 is just past the maximum. With gears 49, 53 in the orientation shown in FIG. 7A. Crimping device 56 is advantageously in the position shown in FIG. 4B when the chord 59 of crimping device 56 is positioned over but out of contact from flange 3.

Referring to FIG. 7B, the gears have been rotated to a position, as represented by point 83 on velocity curve 88 of FIG. 5 where the velocity of shaft 52 is at the low point because shaft 50 has rotated gear 49 to the point of minimum radius at the point of mesh between gears 53 and 49. The corresponding position of crimping device 56 is illustrated in FIG. 4C. It will be noted that at this point the tip velocity of crimping device 56 is at a minimum so that the peripheral speed of crimping device 56 has decreased to the point where tray 1 is traveling faster than the peripheral speed of crimping device 56, tooth member 59 has engaged a portion of upstanding flange 3 and has turned the flange over cover 16.

Referring now to FIG. 7C, gears 53 and 49 have rotated to a position where the velocity of shaft 52, and the peripheral velocity of crimping device 56 are increasing, as represented by point 80 at point 84 on the curve 88 of FIG. 5 and at this point, the peripheral velocity of crimping device 56 is approximately equal to the velocity of tray 1. It will be further noted, referring to FIG. 4D, that the peripheral surface of crimping device 56 is in engagement with cover 16 to hold the cover in position and force the cover down into the opening of tray 1.

Referring now to FIG. 7D, gears 53 and 49 have again rotated to the point where the distance between shaft 50 and the point of mesh of gears 53 and 49 is at a maximum so that the velocity of shaft is at a maximum and the speed of crimping device 56 is maximized as indicated at point 85 of curve 88.

Referring to FIG. 4E, which is illustrative of the position of crimping device 56 when gears 53 and 49 are in the position shown in FIG. 7D, gap 57 is advantageously located in crimping device 56 and positioned with respect to the device to "step over" the trailing edge of flange 3 to prevent outward bending of the flange.

By the foregoing process, cover 16 is placed on flange 2 of tray 1 (FIG. 4B), moved forward along flange 2 to abut the front edge of upstanding flange 3 (FIG. 4C), the tooth member 58 of crimping device 56, which at the time of contact between the tooth member and upstanding flange 3, is moving slower than the linear velocity of tray 1, bends over a portion of the upstanding edge of flange 3 to hold the cover in place. On further movement of tray 1, crimping device 56 rotates at an increasing speed and finally, is in position so that the gap 57 in crimping member 56 steps over the trailing edge of upstanding flange 3 (FIG. 4E).

The foregoing is but one example of apparatus and method within the scope of the present invention, and it is to be understood that various other arrangements or features will occur to those skilled in the art upon reading the disclosure set forth hereinafter, all of which may be within the scope of the claims which follow.

The invention claimed is:

1. An apparatus for supplying and locating a generally planar cover of selected peripheral configuration over a cooperative opening of similar configuraton of a moving container where the opening is surrounded by an outwardly directed generally horizontal cover receiving first flange where the first flange has an upwardly extending second flange so the cover is received on the first flange and within the second flange including:

(a) conveyor means to move said container along a selected first axis at selected first velocity with the opening directed upwardly;

(b) cover supply means to supply a cover to engage the first flange in a direction generally parallel to the direction of travel of the container from a location above the container;

(c) cover feed means to receive the cover from the cover supply means and feed the cover onto the first flange means along a second axis at an acute angle relative to the first axis at a selected second velocity where the velocity component of the cover, in a direction parallel to the first axis, is in excess of the first velocity so the cover means engages the first flange and moves along the first flange until the leading edge of the cover engages the front of the second flange and then feeds the balance of the cover to be fully received within the second flange.

2. The invention of claim 1 wherein said container conveyor means is adapted to receive said container means in cooperative frame means to move said container in a generally horizontal direction, said cover supply means is adapted to sequentially feed said covers to said containers on said conveyor means at intervals determined by the speed of said conveyor means at an acute angle in the direction of travel of the container wherein the cover feed means includes cooperative nip roller means rotated at selected speed to receive said cover means and to direct said cover to receive said first flange means of said container on opposite sides of said container opening means to move thereon at a speed in excess of the speed of the container between opposite sides of the second flange means so the leading edge of the cover moves along the second flanges to engage the front portion of the second flange where because of the speed of the cover feed, the cover bends downwardly toward the second flange and upon release of said cover from said nip roller means said cover is fully received within said second flange means.

3. The invention of claim 1 including bending a portion of the front edge of said second flange inwardly over said cover after said cover has engaged said front portion of said second flange and prior to release of said cover from said nip roller means.

4. The invention of claim 3 wherein said crimping means includes disc means mounted for rotation about a horizontal axis wherein the periphery of the disc rotates in the direction of movement of the tray and engages the front edge of said second flange to bend said second flange over said cover when said cover is located on the first flange at the front of said container including: rotating said disc at a speed where the peripheral velocity of the disc is less than the speed of the container when the disc is in contact with the front edge of the second flange and increasing the speed of rotation of the disc during a portion of the period while the disc is in contact with the cover then slowing the speed of rotation of the disc during a portion of the time in which the disc is in contact with said cover.

5. An apparatus for feeding and placing a cover on an opening to a container where the container opening is surrounded by a generally outwardly extending cover receiving flange means and the first flange is surrounded by an upwardly extending second flange means including:

(a) conveyor means to move said container in a selected direction along a first axis at first velocity;

(b) cover supply means to supply individual covers to be placed on said container opening;

cover feed means located above said conveyor means to receive covers from said cover supply means and feed said covers at an acute angle relative to, and in the direction of, travel of said containers so the front edge of said cover engages the first flange of container moving on said conveyor means where the cover is fed at a second velocity so that the component of the second velocity in the direction of travel of the container is greater than the first velocity so the cover moves on the first flange to engagement with the front edge of the second flange; and (d) means to place the rear edge of the cover within the rear portion of the second flange so the cover is completely received within the second flange and rests on the first flange.

6. The invention of claim 5 wherein said cover supply means includes separator means to remove single covers from a storage means, conveyor means moved at preselected speed to receive single covers from said separator means and transfer said covers to said cover feed means at selected intervals.

7. The invention of claim 5 including crimping means to bend a portion of the front second flange over the cover means when the front edge of the cover means is in contact with the front second flange and before the rear edge of the cover is received within the second flange.

8. The invention of claim 7 wherein said crimping means includes disc means mounted forward of said feed means for rotation about a horizontal axis as the lower portion of the periphery of said disc means moves in the same direction as the direction of movement of said container and contacts the front portion of said second flange of said container as said container moves along said conveyor to bend a portion of the front of said second flange over said cover; and crimping means at selected speed.

9. The invention of claim 8 wherein said disc means has a gap in the periphery thereof and said crimping means drive means rotates said disc at selected speed so that said disc bends a portion of the front edge of said second flange over said cover and said disc is rotated at speed so said rear portion of said second flange is received in said gap means as the rear of said container means passes said disc means to secure the rear portion of the second flange to the cover.

* * * * *